US008161860B2

(12) United States Patent
Grenier et al.

(10) Patent No.: US 8,161,860 B2
(45) Date of Patent: Apr. 24, 2012

(54) ROTARY CUTTER AND ROTARY CUTTING APPARATUS PROVIDED WITH THE ROTARY CUTTER

(75) Inventors: Gilbert Grenier, Annonay (FR); Lillian Monteil, Saint Martin d'Aout (FR)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 11/165,489

(22) Filed: Jun. 24, 2005

(65) Prior Publication Data

US 2006/0048621 A1 Mar. 9, 2006

(30) Foreign Application Priority Data

Jul. 2, 2004 (SE) ..... 0401734

(51) Int. Cl.
*B26D 7/26* (2006.01)

(52) U.S. Cl. ..... 83/698.11; 83/343; 83/659; 83/698.41

(58) Field of Classification Search ..... 83/346–348, 83/659, 469, 698.11, 698.41, 505–507, 508.2–508.3
See application file for complete search history.

(56) References Cited

U.S. PATENT DOCUMENTS

| | | | | | |
|---|---|---|---|---|---|
| 4,420,999 | A | * | 12/1983 | Hirakawa et al. | 83/345 |
| 4,548,112 | A | | 10/1985 | Thomas | |
| 4,770,078 | A | | 9/1988 | Gautier | |
| 5,048,387 | A | * | 9/1991 | Niitsuma et al. | 83/344 |
| 5,058,472 | A | * | 10/1991 | Kakko-Chiloff | 83/344 |
| 5,067,380 | A | * | 11/1991 | Seefeldt | 83/481 |
| 5,083,488 | A | * | 1/1992 | Stanley et al. | 83/344 |
| 5,301,583 | A | * | 4/1994 | Kakko-Chiloff | 83/344 |
| 5,419,224 | A | | 5/1995 | Gamperling et al. | |
| 5,452,634 | A | * | 9/1995 | Wilson | 83/99 |
| 6,585,139 | B1 | | 7/2003 | Holtmann et al. | |
| 6,684,747 | B2 | * | 2/2004 | Aichele | 83/344 |
| 2002/0134882 | A1 | | 9/2002 | Lind | |

FOREIGN PATENT DOCUMENTS

| | | |
|---|---|---|
| DE | 8900516 | 3/1989 |
| JP | 2-100895 | 4/1990 |

* cited by examiner

*Primary Examiner* — Phong Nguyen
(74) *Attorney, Agent, or Firm* — Morgan, Lewis & Bockius LLP

(57) ABSTRACT

A rotary cutter for a rotary cutting apparatus. The rotary cutter includes a shaft and a mantle having at least one cutting member. The shaft is non-rotatable, and the mantle is rotatably mounted to the shaft and can be removed therefrom in an axial direction. The shaft is adapted to be rigidly mounted in a frame part, wherein the mantle is rotatably arranged relative to the shaft. The shaft may be in the form of a single piece, or a pair of axially spaced shaft portions.

2 Claims, 3 Drawing Sheets

ROTARY CUTTER AND ROTARY CUTTING APPARATUS PROVIDED WITH THE ROTARY CUTTER

The present application claims priority under 35 U.S.C. §119 to patent application Ser. No. 0401734-9 filed in Sweden on Jul. 2, 2004.

TECHNICAL BACKGROUND OF THE INVENTION

The present invention relates to a rotary cutter for a rotary cutting apparatus, comprising a shaft and a mantle, the mantle having at least one cutting member.

The invention also relates to a rotary cutting apparatus comprising a frame part, an anvil and such a rotary cutter.

U.S. Pat. No. 4,770,078 discloses in a discussion of the prior art (FIGS. 1-3) a one piece rotary cutter, which has to be removed from the frame when maintenance is needed. In order to allow the machine to be used during maintenance, a further rotary cutter including its static (stationary) shaft must always be accessible.

In order to overcome that problem, U.S. Pat. No. 4,770,078 suggests to divide the rotary cutter into a rotatable shaft and a mantle. The mantle is connected to the rotatable shaft by means of pneumatic pressure. A drawback with this kind of rotary cutter is that it is difficult to index the rotary cutter relative to the anvil. Another drawback is the lack of support of the rotary cutter on the axial side thereof opposite to the driven side.

SUMMARY OF THE INVENTION

An object of the invention is to improve the adjustment possibilities of the rotary cutter. It is a further object to allow maintenance to be performed at a reduced cost and to be able to dismantle the rotary cutter in a simplified manner.

This has been achieved by a rotary cutter and a rotary cutting apparatus of the initially defined kind, wherein the shaft is adapted to be rigidly mounted in a frame part, and wherein the mantle is rotatably arranged relative to the shaft and removable therefrom. Hereby, indexing of the mantle relative to the shaft is made easier, since the mantle can be rotated relative to the static shaft. Furthermore, it is only necessary to perform maintenance of the mantle, i.e. the existing shaft can be used together with another mantle such that the production can be continued while maintenance is performed on the worn mantle.

Preferably, the mantle is adapted to be connected to a power source for creating a rotational movement of the mantle.

Preferably bearings are provided between the mantle and the shaft. Hereby, a controlled positional and relative rotational relationship between the static shaft and the mantle is achieved.

Suitably, a power transmission means is provided for transmitting the rotational movement to said mantle.

Advantageously, the mantle has an axial extension and opposite axial ends, wherein said mantle is adapted to be supported by the shaft and connected to the power source in the region of one of the ends of said mantle, and wherein said mantle is adapted to be supported by the shaft in the region of the opposite end.

Alternatively, said shaft is divided into first and second shaft portions, the mantle having an axial extension and opposite axial ends, wherein said mantle is adapted to be supported by the first shaft portion and connected to the power source in the region of one of the ends of said mantle, and wherein said mantle is adapted to be supported by the second shaft portion in the region of the opposite end.

Advantageously, the frame part of the rotary cutting apparatus further comprises a fastening means for said shaft and a power transmission connection means for said mantle.

BRIEF DESCRIPTION OF THE DRAWINGS

In the following, preferred embodiments of the invention will be described in greater detail by reference to the accompanying drawings, in which.

DETAILED DESCRIPTION OF PREFERRED EMBODIMENTS

Figure 1:
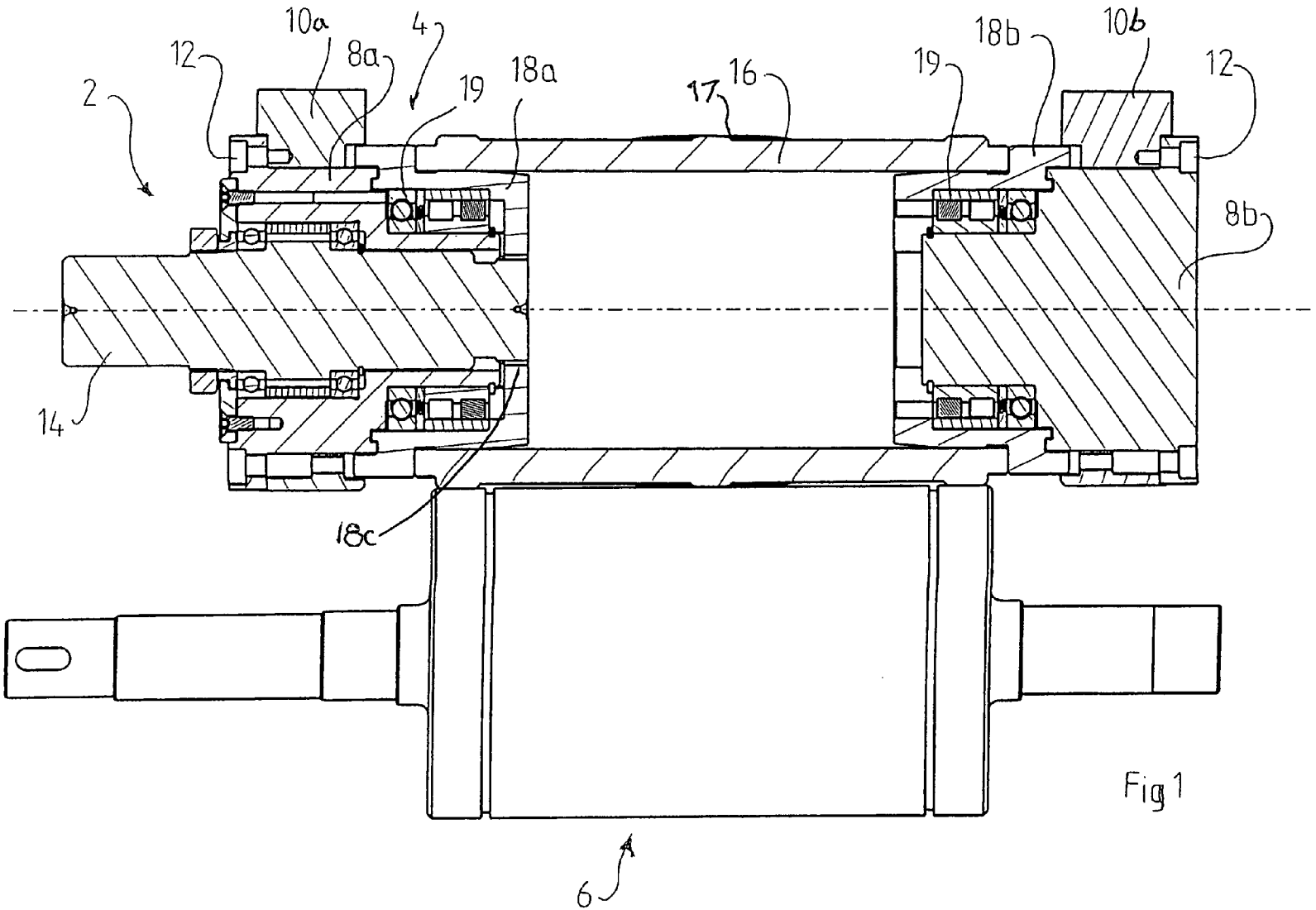
FIG. 1 illustrates a rotary cutting apparatus comprising an anvil and a rotary cutter according to a first embodiment of the invention, shown in longitudinal section.

FIG. 1 shows a rotary cutting apparatus 2, comprising a rotary cutter 4 and an anvil roll 6. The rotary cutter 4 comprises a divided static (non-rotary) shaft 8, comprising shaft portions or members 8*a*, 8*b*, each shaft member being rigidly connected to a respective frame part 10*a*, 10*b* by means of screws 12. A drive axle 14 associated with a not-shown power source extends through the shaft member 8*a* for transmitting a rotational movement to a tool in the form of a mantle 16 via an intermediate transmission member 18*a* which is rotatably mounted on an outer periphery of the shaft member 8*a* The rotary motion is transmitted from the axle 14 to the member 18*a* via teeth 18*c*. The rotational movement is further transmitted to a rotational support 18*b*. Cylindrical bearings 19 are provided between the shaft members 8*a*, 8*b* and the intermediate transmission members 18*a*, 18*b*, respectively, for centering the mantle 16 relative to the shaft members 8*a*, 8*b*. The frame parts 10*a*, 10*b* are secured to the rest of a stationary frame by means of suitable, not-shown fastening means. The mantle 16 is provided with at least one cutting member 17.

During disassembly, the frame parts 10*a*, 10*b* are unsecured from the not-shown rest of the frame such that the static shaft members 8*a*, 8*b*, plus the transmission members 18*a*, 18*b*, can be pulled axially out from the mantle 16. The mantle 16 is taken away and maintenance can thus be performed. Another mantle 16 is mounted in place of the removed one, and the rotary cutting device can be utilised without long stoppage.

Of course, it may be enough to remove only one (either) of the static shaft members 8*a* and 8*b*, respectively, rather than both.

Figure 2:
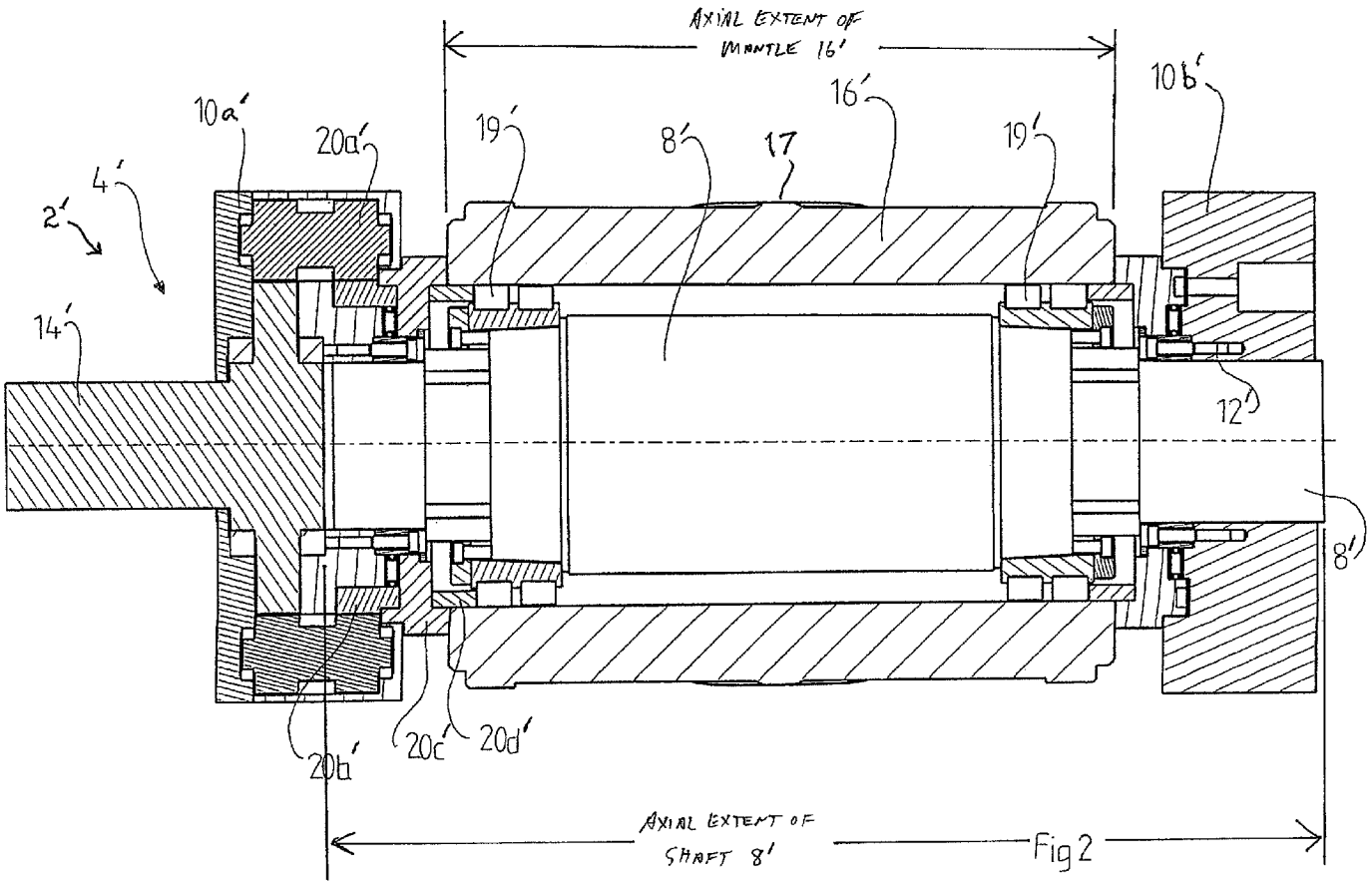
FIG. 2 is a longitudinal sectional view of a second embodiment of the rotary cutter.

FIG. 2 shows a second embodiment of a rotary cutting apparatus 2' and a rotary cutter 4'. The static shaft 8' in this case comprises a single part and is connected to the frame parts 10*a*', 10*b*' on either side of the mantle 16' by screws 12'. The rotational movement of the drive axle 14' is transmitted to the mantle 16' transmission mechanism which includes gears 20*a*', 20*b*', 20*c*', 20*d*'. It should be noted that the parts 20*b*', 20*c*', 20*d*' could be produced as two pieces or even one single piece. Centering is performed by means of cylindrical bearings 19'.

During disassembly, the frame part 10*b*' in the right part of FIG. 2 is unsecured from the rest of the frame (i.e. the left frame part remains secured). The mantle 16' can then be pulled axially away from the tool holder 8'.

Figure 3:
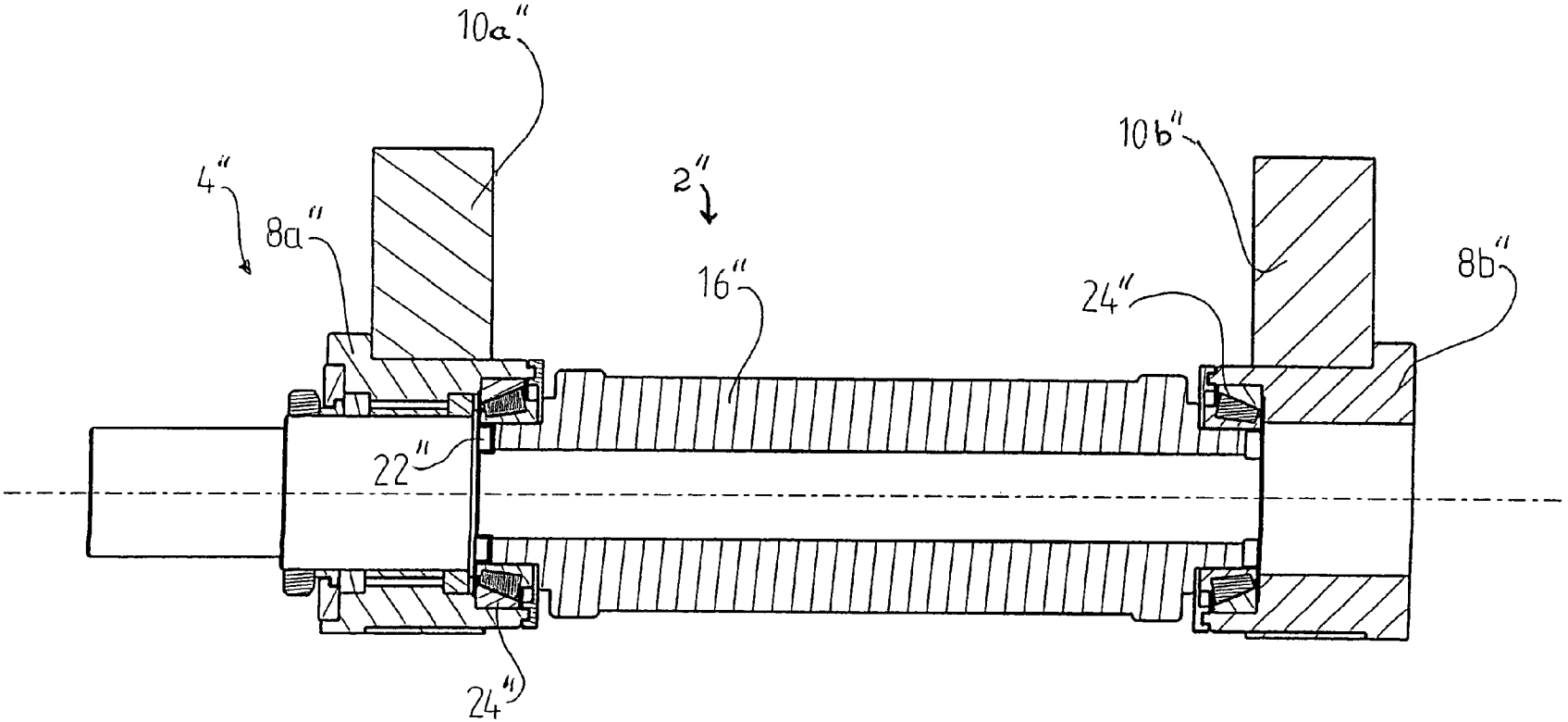
FIG. 3 is a longitudinal sectional view of a third embodiment of the rotary cutter.

FIG. 3 shows a third embodiment of a rotary cutting apparatus 2" and a rotary cutter 4". In this case, the cross-section is such that the cutting member has been omitted. The drive axle 14" transmits rotational movement directly to the mantle 16" via a coupling member 22" which is received in a recess of the mantle. The static shaft 8" is divided into two shaft members or portions 8*a*", 8*b*" connected to the respective frame parts 10*a*", 10*b*" on either side of the mantle 16". The mantle 16" is centered relative to the shaft members 8*a*", 8*b*" and the driving axle 14" by means of conical bearings 24".

For maintenance purposes, the shaft member 8*b*" is unsecured from the frame parts 10*a*", 10*b*", and then the mantle 16" is released axially from the shaft member 8*a"*.

The mantle 16, 16', 16" may be made of a multiphase material, such as steel, cemented carbide or cermet (hard phase bonded by a metal).

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A rotary cutting apparatus comprising:

a housing;

a hollow first shaft member and a second shaft member removably connected to the housing and being non-rotatable relative to the housing;

a mantle carrying at least one cutter element and mounted for rotation with respect to the housing and for rotation relative to the first and second shaft members about a longitudinal axis of the first and second shaft members, opposing ends of the mantle radially overlapping with the first and second shaft members and the mantle removable from the first and second shaft members by removing the first shaft member and the second shaft member in an axial direction;

a rotary drive mechanism connected to the mantle for rotating the mantle, wherein the first and second shaft members are separate members spaced apart along the longitudinal axis of the first and second shaft members, and opposing ends of the first and second shaft members are each rigidly connected to the housing and non-rotatable relative to the housing;

wherein the rotary drive mechanism comprises a drive axle and a transmission member, the drive axle is partially received in the hollow first shaft member;

wherein one end of the drive axle is connected to a drive source and the other end of the drive axle has teeth;

wherein the transmission member has teeth and is rotatably mounted on an outer periphery of the first shaft member and overlaps with the mantle and the first shaft member, the teeth of the transmission member engages with the teeth of the drive axle to transmit the rotation of the drive axle to the mantle.

2. The rotary cutting apparatus according to claim 1 further including an anvil mounted opposite the mantle and engageable with the at least one cutting member.

* * * * *